US006456817B1

(12) United States Patent
Kamiya

(10) Patent No.: US 6,456,817 B1
(45) **Date of Patent: *Sep. 24, 2002**

(54) FIXING DEVICE HAVING AN INTRUDING SEPARATION MEMBER

(75) Inventor: Yuji Kamiya, Abiko (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/520,162

(22) Filed: Mar. 7, 2000

(30) Foreign Application Priority Data

Mar. 9, 1999 (JP) ..... 11-062051

(51) Int. Cl.[7] ..... G03G 15/20

(52) U.S. Cl. ..... 399/323; 271/311

(58) Field of Search ..... 399/323, 399; 271/308, 311, 900

(56) References Cited

U.S. PATENT DOCUMENTS 5,557,427 A 9/1996 Kamiya
5,721,627 A 2/1998 Kamiya

FOREIGN PATENT DOCUMENTS

JP 10-48991 * 2/1998

* cited by examiner

*Primary Examiner*—Joan Pendegrass
(74) *Attorney, Agent, or Firm*—Fitzpatrick, Cella, Harper & Scinto

(57) ABSTRACT

A fixing device includes a roller arranged to come into contact with a recording member bearing an unfixed image thereon so as to fix the unfixed image to the recording member, and a separation member arranged to come into contact with the roller so as to separate the recording member from the roller. A fore end of the separation member on a side for coming into contact with the roller is formed in a curved surface and intrudes into the roller. An amount of intrusion of the separation member into a surface of the roller is not less than a radius of a circle of curvature of the curved surface of the fore end of the separation member and not more than a diameter of the circle of curvature.

8 Claims, 7 Drawing Sheets

FIXING DEVICE HAVING AN INTRUDING SEPARATION MEMBER

BACKGROUND OF THE INVENTION

1. Field of the Invention

The present invention relates to a fixing device used for fixing a toner image transferred onto a transfer member serving as a recording member in an image forming apparatus which forms images, for example, by an electrophotographic method or the like. More particularly, the present invention relates to an improvement on the fixing device in respect to the transfer-member separability and the service lives of a fixing roller and a pressing roller.

2. Description of Related Art

The fixing device of the above-stated kind is composed of a heat source, a fixing roller arranged to fix, with heat and pressure, a toner image transferred to a transfer member to the transfer member, and a pressing roller arranged to apply a pressure from the back side of the transfer member.

Since the fixing roller applies heat while being in contact with the toner image, the fixing roller is in most cases provided with an elastic layer which is typically a rubber layer. Since, in most cases, the transfer member is a sheet having a rugged surface, such as a paper sheet, the use of the elastic layer ensures a better adhesion of the toner to the rugged surface of the transfer member. With the fixing roller provided with an elastic layer, therefore, heat can be efficiently transmitted with elasticity to the toner image on the transfer member. Generally, to improve the releasing ability for the toner, the surface of the fixing roller is coated with a fluororesin layer or the like irrespective of the presence or absence of the elastic layer.

The pressing roller comes into pressed-contact with the fixing roller to form a predetermined nip part between them. In many cases, the pressing roller is provided with an elastic layer such as a rubber layer, as in the fixing roller, for shortening heat transmission time. The toner on the transfer member is fixed by its contact with the fixing roller. However, to prevent contact of the pressing roller with the toner in forming images on both sheet surfaces and to prevent a foreign matter or smut, such as residual toner, on the fixing roller from sticking to the pressing roller, the surface of the pressing roller is also coated with a fluororesin or the like in general.

Further, the fixing roller or both the fixing roller and the pressing roller are provided with a separation claw having a pointed fore end for preventing entanglement or clinging of the transfer member to the roller. To ensure a sufficient separating effect on the transfer member with a thickness of about 100 $\mu$m, the separation claw is generally arranged to have its fore end formed into a minute curved shape of a radius of curvature of 100 $\mu$m or less.

The fixing device which is provided with such a separation claw shows a good separating performance for a normal transfer member. However, in the event of a transfer member which is vulnerable to heat, or has a sharp edged sectional shape at its fore end or is extremely thin in thickness, the separating ability of the fixing device becomes insufficient and thus tends to have the transfer member stick or cling to the fixing roller or to the pressing roller.

It has been known through experience that this problem can be solved by arranging the fore end of the separation claw to be very sharp measuring less than 10 $\mu$m in radius of curvature. However, if the fore end of the separation claw is simply arranged to be sharp, the sharp end of the separation claw tends to pierce the surface of the fixing or pressing roller in a case where the roller is provided with an elastic layer. In such a case, the surface of the roller would be peeled off to shorten the service life of the roller.

Further, if the separation claw is arranged to have such a sharp fore end that measures less than 5 $\mu$m, it increases a dynamic load on the surface of the roller to cause large abrasion of the surface of the roller and thus also shortens the service life of the roller.

Therefore, it has been hardly possible with the conventional fixing device to make the long service life of the roller compatible with a good separability for a transfer member which tends to stick and cling to the roller.

BRIEF SUMMARY OF THE INVENTION

It is a general object of the invention to provide a fixing device improved in recording-member separability and service life of a roller.

It is a more specific object of the invention to provide a fixing device, which comprises a roller arranged to come into contact with a recording member bearing an unfixed image thereon so as to fix the unfixed image to the recording member, and a separation member arranged to come into contact with the roller so as to separate the recording member from the roller, wherein a fore end of the separation member on a side for coming into contact with the roller is formed in a curved surface and intrudes into the roller, and an amount of intrusion of the separation member into a surface of the roller is not less than a radius of a circle of curvature of the curved surface of the fore end of the separation member and not more than a diameter of the circle of curvature.

It is another object of the invention to provide a fixing device, which comprises a roller arranged to come into contact with a recording member bearing an unfixed image thereon so as to fix the unfixed image to the recording member, and a separation member arranged to come into contact with the roller so as to separate the recording member from the roller, wherein a fore end of the separation member on a side for coming into contact with the roller intrudes into the roller, and the following condition is satisfied:

$$90^\circ \leqq \theta < \theta 0$$

where $\theta$ is an angle which a tangential line of the fore end of the separation member at a position where the fore end of the separation member intersects a surface of the roller before the separation member comes into contact with the roller makes with a tangential line of the surface of the roller at the above-mentioned position before the separation member comes into contact with the roller, and $\theta 0$ is an angle which a surface of the separation member for guiding the recording member makes with a tangential line of the surface of the roller at a position where a line of the surface of the separation member in a direction of guiding the recording member intersects the surface of the roller before the separation member comes into contact with the roller.

The above and further objects and features of the invention will become apparent from the following detailed description of preferred embodiments thereof taken in connection with the accompanying drawings.

DETAILED DESCRIPTION OF THE INVENTION

Hereinafter, preferred embodiments of the invention will be described in detail with reference to the drawings.

First Embodiment

Figure 1:
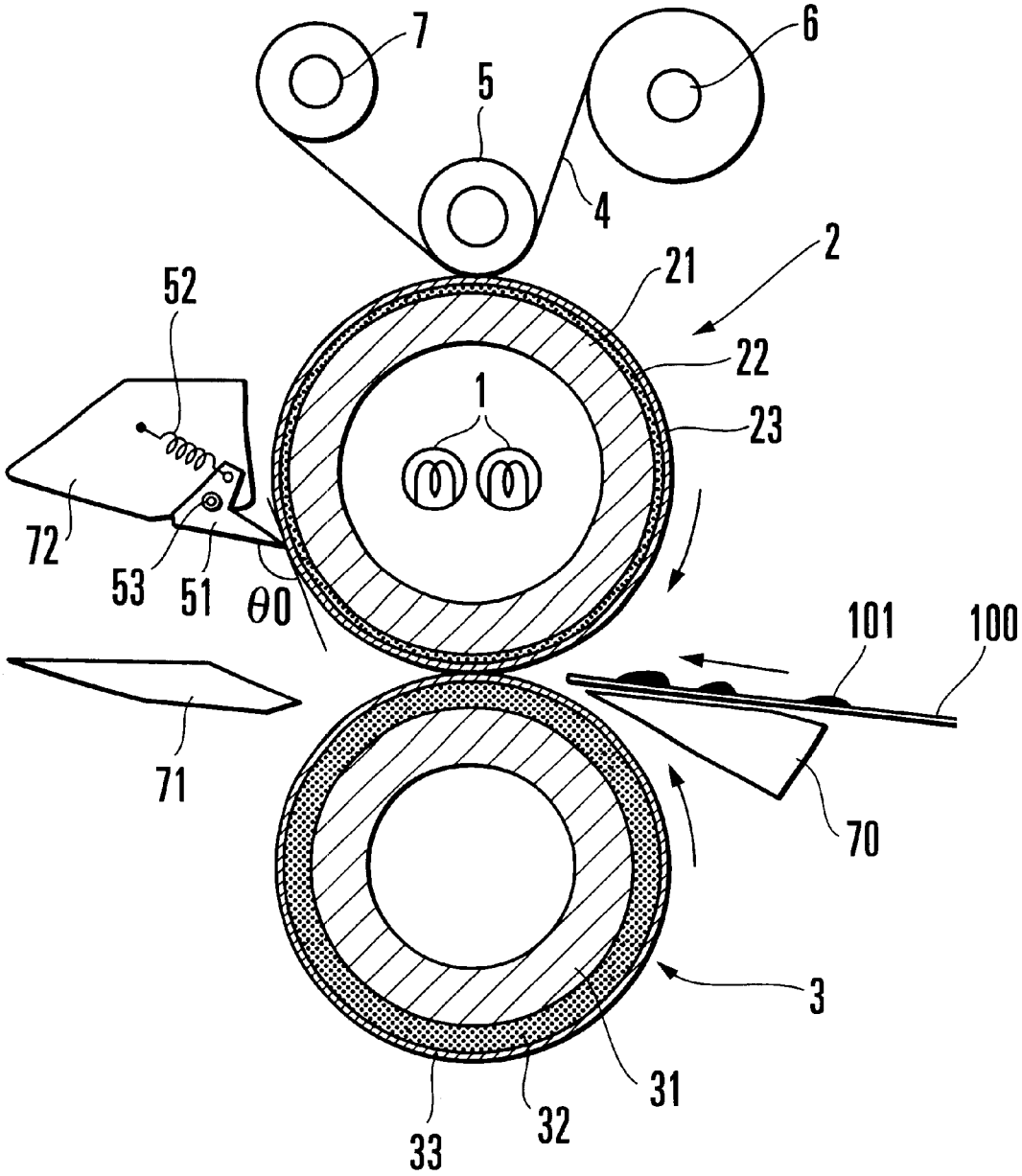
FIG. 1 is a sectional view showing the outline arrangement of a fixing device according to a first embodiment of the invention.

FIG. 1 is a sectional view showing the outline arrangement of a fixing device according to a first embodiment of the invention. The fixing device has a halogen heater 1 disposed therein serving as a heat source. The fixing device is composed of a fixing roller 2 which is arranged to fix a toner image 101 formed on a recording member 100 to the recording member 100 with heat and pressure, and a pressing roller 3 which is arranged to apply a pressure to the recording member 100 from the backside thereof.

The fixing roller 2 is formed by coating a core metal 21 which is made of an alloy mainly made of aluminum with a silicone rubber layer 22 which is an elastic layer to a thickness of 300 μm. The elastic layer 22 is further coated by baking with a layer 23 of polytetra-fluoroethylene (PTFE) as a surface layer to a thickness of 20 μm.

The core metal 21 is not only a structural base of the fixing roller 2 but also acts to regenerate heat by receiving radiation heat from the halogen heater 1 and also to stabilize the temperature of the PTFE layer 23 which comes into contact with a toner. The temperature of the fixing roller 2 is adjusted to be from 160 to 200° C. on the basis of temperature measured by a temperature adjusting thermistor (not shown).

The pressing roller 3 is formed with a core metal 31 which is made of an alloy mainly made of iron. The core metal 31 is coated with a silicone rubber layer 32 which is an elastic layer to a thickness of 5 mm. The elastic layer 32 is coated further with a tetrafluoroethylene-perfluoroalkyl vinyl ether copolymer (PFA) layer 33 to a thickness of 100 μm. The pressing roller 3 is arranged to be in pressed-contact with the fixing roller 2 to form a predetermined nip part for transporting the recording member 100 in a state of being pinched (nipped) in between the two rollers 2 and 3.

To enable the recording member 100 to smoothly pass, an entrance guide plate 70 is arranged on the entrance side of the nip part and a delivery guide plate 71 is arranged on the delivery side of the nip part to have the same width as that of the recording member 100. A separation claw guide 72 is disposed above the delivery guide plate 71.

To prevent as much as possible a toner image 101 formed on the recording member 100 from sticking and clinging to the fixing roller 2, a web roller 5 which has a silicone rubber is arranged to cause a web (unwoven cloth) 4 to abut on the fixing roller 2. The web 4, which is impregnated with silicone oil of 10,000 cs viscosity, applies the silicone oil to the surface of the fixing roller 2. The web 4 is payed out to a very small extent from a feed roller 6 to be taken up on a take-up roller 7 every time the recording member 100 passes. Smuts or contaminants existing on the fixing roller 2 are removed at the same time when the silicone oil is applied by the web 4. The contaminants or smuts on the fixing roller 2 include remnants of the toner coming from the recording member 100, paper dust and unnecessary oil.

To prevent entanglement of the recording member 100 in a state of sticking to the fixing roller 2, the fixing roller 2 is provided with a separation claw 51, i.e., a separation member, having a pointed fore end. The separation claw 51 has a base body mainly made of polyimide. The base body is coated with a coating layer which is mainly made of PFA and measures about 20 μm in thickness.

Figure 2:
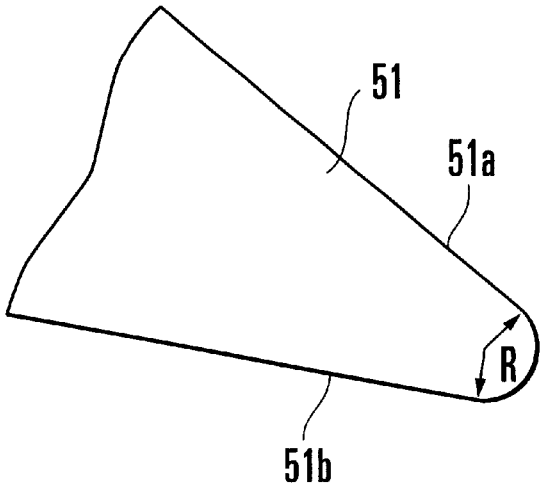
FIG. 2 is a sectional view showing the fore end of a separation claw disposed at a fixing roller of the fixing device shown in FIG. 1.

As shown in FIG. 2, the fore end of the separation claw 51 is formed to have a minutely curved surface. The fore end curved surface forms a smooth arc between the upper and lower ridge lines 51*a* and 51*b* extending to the fore end of the separation claw 51. In the case of the first embodiment, a radius of the curved surface of the fore end of the separation claw 51, i.e., a radius R of a circle of curvature (a radius of curvature) passing on the curved surface, is arranged to be 50 μm.

The separation claw 51 is mounted, with a shaft 53, on the body of the fixing device in the neighborhood of the separation claw guide 72 in such a way as to be swingable. A tension spring 52, serving as urging means, which is secured to the body of the fixing device is arranged to pull the upper end of the separation claw 51. Under the pulling force of the spring 52, the fore end of the separation claw 51 is caused to abut on the surface of the fixing roller 2 with a predetermined abutting pressure.

The width of the fore end of the separation claw 51 in the longitudinal (axial) direction of the fixing roller 2 is 2 mm. The fore end of the separation claw 51 is uniformly in contact with the fixing roller 2 at this width part which measures 2 mm. The separation claw 51 is arranged in a plural number suited for the size of the recording member 100. The plurality of separation claws 51 are arranged in the longitudinal direction of the fixing roller 2. In the case of the first embodiment, a total of four separation claws 51 are arranged.

Figure 6A:
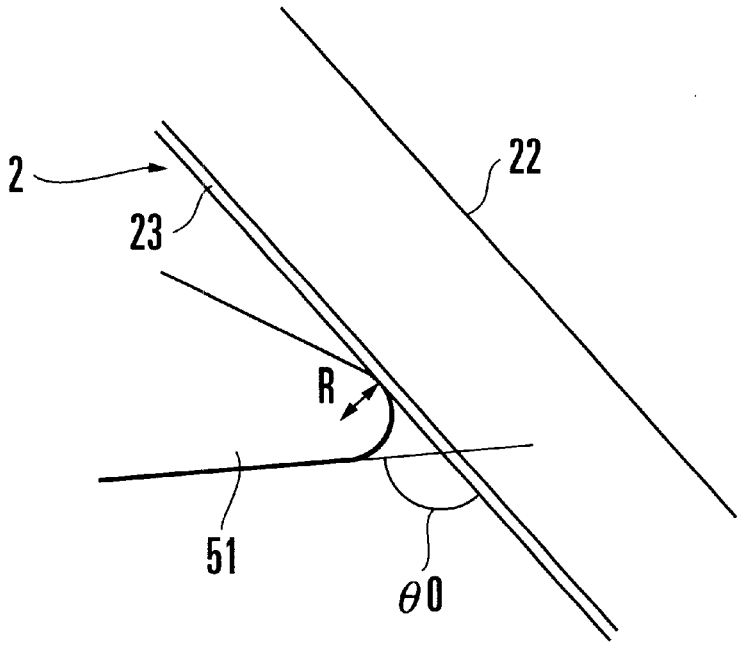
FIGS. 6(*a*) and 6(*b*) are sectional views showing two examples of relation between the amount of intrusion δ of the fore end of the separation claw shown in FIG. 2 into the surface of the fixing roller and a radius of curvature R of the fore end of the separation claw.
Figure 6B:
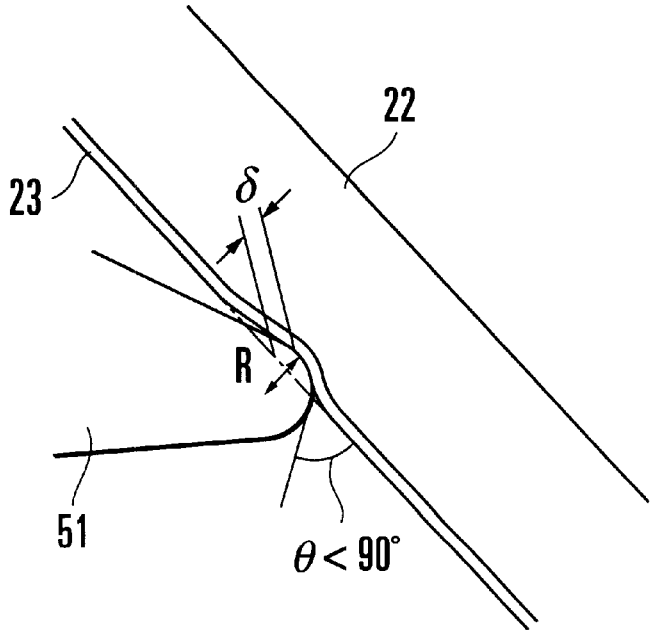

The separation claw 51 is set to have a bottom surface (the ridge line 51*b*) of the fore end part of the separation claw 51 at an obtuse angle θ0 with a tangential line of the surface of the fixing roller 2 obtained at a position where the line of the bottom surface of the separation claw 51 intersects the surface of the fixing roller 2 before the separation claw 51 comes into contact with the fixing roller 2, as shown in FIG. 6(*a*). The separation claw 51 abuts on the surface of the fixing roller 2 at such a setting angle θ0 and, then, the separation claw 51 intrudes a predetermined amount into the surface of the fixing roller 2. In the case of the first embodiment, the setting angle θ0 is set at 130°. The bottom surface of the separation claw 51 is provided for the purpose of guiding the recording member 100.

It is an important feature of the invention to restrict the amount of intrusion of the separation claw 51 into the surface of the fixing roller 2. To examine the relation of the abutting pressure of the separation claw 51 on the surface of the fixing roller 2 to the amount of intrusion of the fore end of the separation claw, the inventor of the present invention conducted tests in the following manner.

Figure 3:
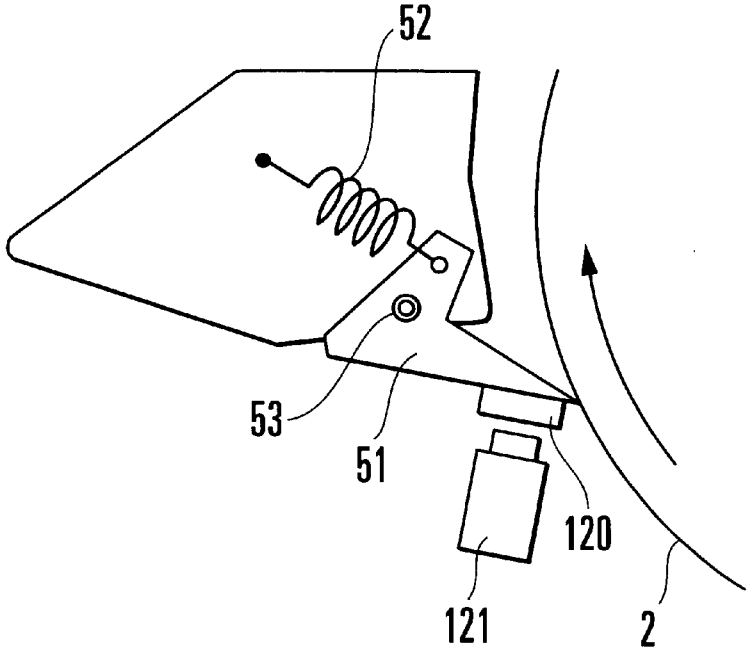
FIG. 3 is a diagram for explaining a method of measuring an amount of intrusion δ of the fore end of the separation claw shown in FIG. 2 into the surface of the fixing roller.

Referring to FIG. 3, a metal piece 120 was attached to the bottom surface of the fore end part of the separation claw 51. The separation claw 51 was pushed against the surface of the fixing roller 2 to intrude into the surface of the fixing roller 2 by pulling the separation claw 51 with the tension spring 52 to cause the separation claw 51 to swing on the shaft 53. Then, a distance between the metal piece 120 and a gap sensor 121 mounted on the body of the fixing device was measured with the gap sensor 121 so as to measure the amount of intrusion of the fore end of the separation claw 51.

The gap sensor 121 is of an eddy current type which is arranged to be capable of measuring its distance from the metal piece 120 without touching the metal piece 120. The distance measuring direction of the gap sensor 121 is not directed toward the direction of the axis of the fixing roller 2. However, the amount of intrusion of the fore end of the separation claw 51 can be obtained by applying simple geometric conversion to the distance measured by the gap sensor 121. In the above-stated tests, the amount of intrusion of the fore end of the separation claw 51 was measured while variously changing the spring force of the tension spring 52.

Further, in the tests, the amount of intrusion of the fore end of the separation claw 51 was measured also without using the tension spring 52. In this case, since the separation claw 51 would part from the fixing roller 2 due to its own weight, the measuring system shown in FIG. 3 was arranged upside down to have the separation claw 51 in contact with the surface of the fixing roller 2 by its own weight. Further, compared with the pulling force of the tension spring 52, the abutting pressure obtained by the weight of the separation claw 51 itself was small and negligible.

Figure 4:
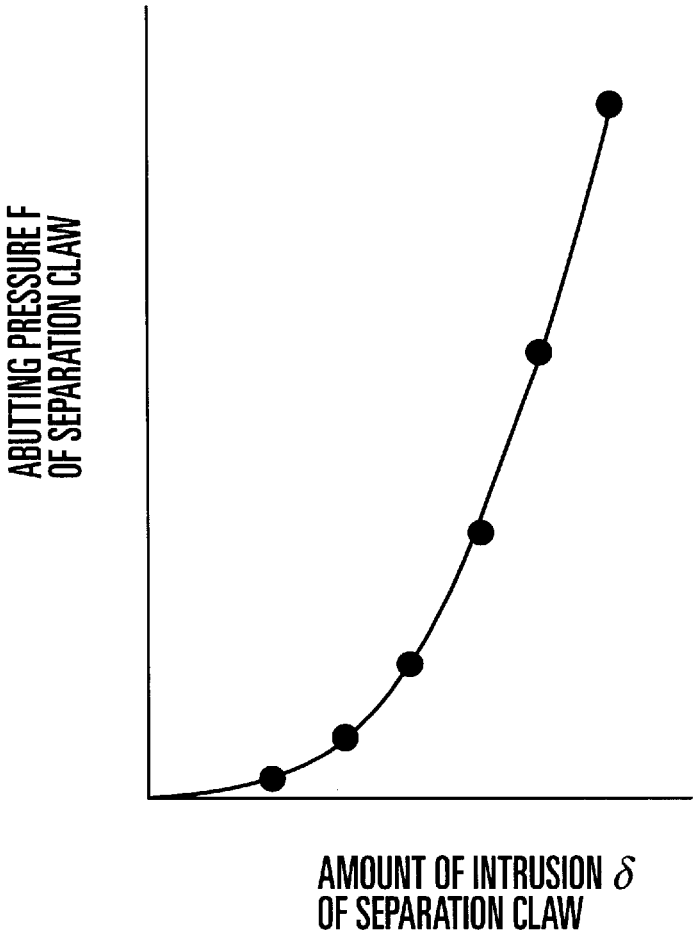
FIG. 4 is a graph showing the amount of intrusion δ of the fore end of the separation claw measured by the method shown in FIG. 3 in relation to the abutting pressure F of the separation claw.

The results of examination of the relation of the amount of intrusion δ to the abutting pressure F of the fore end of the separation claw 51 on the fixing roller 2 were as shown in FIG. 4. As is apparent from FIG. 4, the abutting pressure F is in a near parabolic relation to the amount of intrusion δ. It was thus found that, in order to double the amount of intrusion δ, the abutting pressure F must be quadruplicated.

Figure 5A:
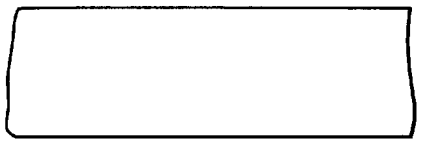
FIGS. 5(*a*) and 5(*b*) are sectional views showing an ordinary recording member which has a rectangular edged end surface and is arranged to be passed through the fixing device shown in FIG. 1 and another recording member which has a sharp end surface, respectively.
Figure 5B:
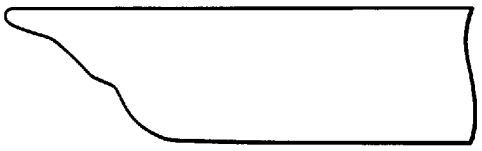

A microscopic observation reveals that the end surfaces of the recording members generally have a sectional shape having a rectangular edge as shown in FIG. 5(*a*). Some of them, however, have their end surfaces in sectional shapes having oblique sharp edges, for example, as shown in FIG. 5(*b*). According to the results of observation made by the inventor of the present invention, such sharp edged end surfaces were often found particularly in OHT films.

It has been observed through tests that the recording members having such sharp edged end surfaces are inferior in separability from the fixing roller or the pressing roller. When a recording member of such an inferior separability is allowed to pass a fixing device, it tends to stick to the fixing roller to cause jamming. However, it has been ascertained that the separability, of even such a recording member, can be improved by making the sectional shape of the end surface of the recording member into such a rectangular sectional shape as shown in FIG. 5(*a*) or by having the recording member shown in FIG. 5(*b*) arranged upside down. Therefore, the cause of inferior separability is attributable to the end surface shape of the recording member and not to the composition thereof.

Table 1 below shows the results of tests conducted while varying the amount of intrusion δ by adjusting the abutting pressure F according to the relation between the abutting pressure F and the amount of intrusion δ shown in FIG. 4. The results of tests include the separability and scars inflicted on the fixing roller by the use of a recording member having such a sharp edged end surface as shown in FIG. 5(*b*) and the service life of the fixing roller obtained from the use of ordinary paper sheets having a rectangular end surface edge as shown in FIG. 5(*a*).

TABLE 1

| Abutting pressure F (gf): | 20 | 30 | 40 | 80 | 150 | 200 |
|---|---|---|---|---|---|---|
| Amount of intrusion δ (μm): | 34 | 43 | 54 | 70 | 100 | 125 |
| Ratio of amount of intrusion δ to radius of curvature R of fore end: | 0.68 | 0.86 | 1.08 | 1.4 | 2.0 | 2.5 |
| Frequency of jamming with sharp edged recording member (%): | 100 | 45 | 0 | 0 | 0 | 0 |
| Scars of roller due to jamming by sharp edged recording member (%): | 100 | 100 | — | — | — | — |
| Service life of roller with ordinary paper (10,000 sheets): | 35 | 28 | 22 | 13 | 7 | 4 |

In Table 1 above, the ratio of the amount of intrusion δ to the radius of curvature R of the fore end was obtained by dividing the value δ by the value R, i.e., δ/R. The frequency of jamming was the number of occurrences of a jamming state, including the sticking to the fixing roller, having taken place with 20 sheets of a recording member having a sharp edged end surface passed and was expressed in percentage. The state of having the frequency of jamming at zero percent indicates that the recording member is stably passed. As shown in Table 1, the paper (recording member) passing state comes to stabilize when the amount of intrusion δ comes to reach a sufficiently large value, such as 54 μm or thereabout. It was found that, at the amount of intrusion of 54 μm, the frequency of jamming sharply drops to stabilize the recording member passing state when the ratio of the amount of intrusion δ to the radius of curvature R of the fore end of the separation claw, i.e., δ/R, is around 1.0. It was also found that the jamming inflicts scars on the fixing roller with probability of 100%.

On the other hand, in a case where a recording member typically represented by an ordinary paper sheet having a rectangular edged end surface was passed, the service life of the fixing roller was drastically shortened by an increases in the abutting pressure F, as shown in Table 1. With the abutting pressure F of the separation claw 51 increased, the PTFE layer 23 of the fixing roller 2 was completely peeled off by the abutting of the separation claw 51 to expose the silicone rubber layer 22 formed beneath the PTFE layer 23. The toner then came to permanently stick to the surface of the silicone rubber layer 22. The toner on the silicone rubber layer 22 then came to stick to the white ground part of the recording member to bring about a state of being contaminated with the toner. The service life of the fixing roller 2 was decided to be terminated by such a contaminated state.

As is apparent from this, if the amount of intrusion δ of the fore end of the separation claw 51 is simply increased with importance set on the separability of the recording medium, the increase of the amount of intrusion δ shortens the service life of the fixing roller with respect to the use of ordinary paper sheets. The service life of the fixing roller becomes longer for the use of ordinary paper sheets by setting the amount of intrusion δ at a value less than 50 μm. However, there is the problem that jamming by a sharp fore-end edged recording member brings forth scars on the fixing roller. Such a scar at once deprives the fixing roller of its service life. The fixing roller might be forced to be replaced with another for a scar inflicted thereon by the first sheet of a sharp fore-end edged recording member.

Unlike the termination of service life of the fixing roller by the use of ordinary paper sheets, in the case of the termination of service life by jamming due to the sharp edged end surface of the recording member, the recording member jamming in the neighborhood of the separation claw 51 pushes up the separation claw 51 from below to cause a large abutting pressure of several hundreds of gf which is much larger than an ordinary abutting pressure to be exerted on the fixing roller 2. As a result, the fore end of the separation claw 51 thrusts itself into and breaks the PTFE layer 23 and the silicone rubber layer 22 to suddenly make the fixing roller 2 unserviceable. Therefore, even an amount of intrusion of less than 50 μm is not safe enough.

In view of this problem, the separation claw 51 in the first embodiment is arranged to have the ratio of the amount of intrusion δ of the fore end of the separation claw 51 into the surface of the fixing roller 2 to the radius of curvature R of the fore end of the separation claw 51 set at a value not less than 1.0 and not more than 2.0. In other words, the amount of intrusion δ is set at a value not less than the radius (R) of a circle of curvature of the curved surface of the fore end of the separation claw 51 and not more than the diameter of the circle of curvature of the curved surface of the fore end of the separation claw 51. Then, in the first embodiment, such setting of the amount of intrusion is realized by adjusting the abutting pressure F of the fore end of the separation claw 51 on the fixing roller 2 by means of the tension spring 52.

The above-stated arrangement of the fore end surface of the separation claw in the first embodiment prevents the sudden termination of service life of the fixing roller, by securing adequate separability for a recording member having a sharp edged end surface, and also enables the fixing roller 2 to have an adequate service life for use of a recording member having a rectangular edged fore end surface typically represented by an ordinary sheet of paper. The amount of intrusion δ of the fore end of the separation claw is preferably set at a value slightly larger than the radius of curvature R. Such a preferred value of the amount of intrusion 6 maximizes the service life of the fixing roller while ensuring adequate recording member separability.

Figure 7A:
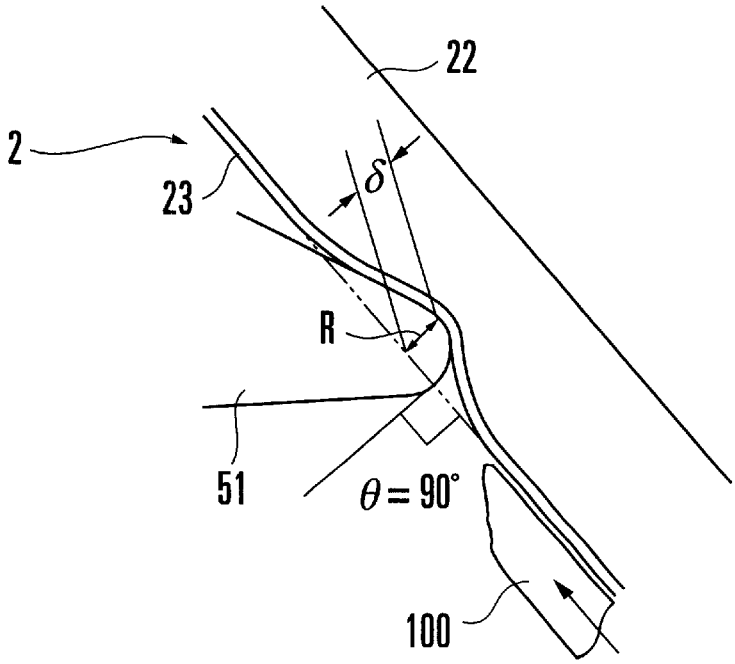
FIGS. 7(*a*) and 7(*b*) are sectional views showing further two examples of relation between the amount of intrusion δ and the radius of curvature R.
Figure 7B:
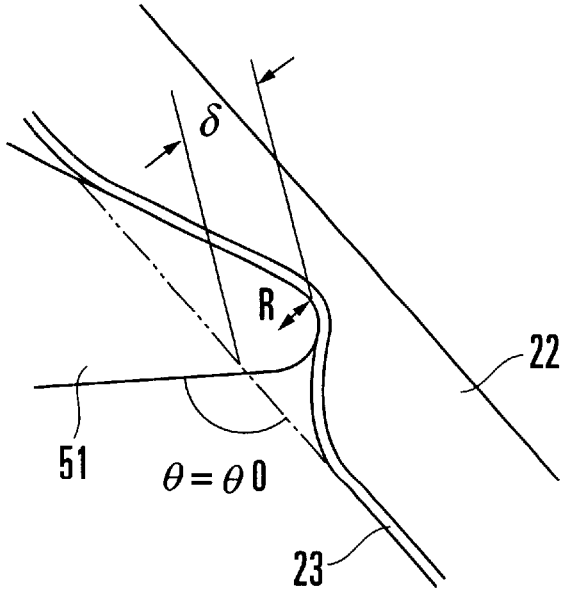

FIGS. 6(*a*) and 6(*b*) and FIGS. 7(*a*) and 7(*b*) show by way of example the relation between the amount of intrusion δ of the fore end of the separation claw 51 into the surface of the fixing roller 2 and the radius of curvature R of the fore end. The mechanism of relation of the amount of intrusion of the fore end of the separation claw to the separability is described below with reference to these figures. The fore end of the separation claw 51 is abutting on the PTFE layer 23 with which the silicone rubber layer 22 of the fixing roller 2 is coated.

FIG. 6(*a*) shows a case where the amount of intrusion δ is zero. In this case, the setting angle θ0 of the separation claw 51 with respect to the fixing roller 2, i.e., the angle of the bottom surface of the fore end part of the separation claw 51 with respect to the tangential line of the surface of the fixing roller 2 is an obtuse angle of 130°. It is to be noted that, in FIGS. 6(*a*), 6(*b*), 7(*a*), 7(*b*) and 9, which are microscopic illustrations, the line of the surface of the fixing roller 2 and the tangential line of the surface of the fixing roller 2 are illustrated as coinciding with each other.

FIG. 6(*b*) shows another case where the amount of intrusion δ is smaller than the radius of curvature R of the fore end of the separation claw 51. As shown in FIG. 6(*b*), an angle (an intersecting angle) θ which the tangential line of the fore end of the separation claw 51 at a position where the fore end of the separation claw 51 intruding the surface of the fixing roller 2 intersects a surface of the fixing roller 2 (indicated by a two-dot chain line) before the separation claw 51 abuts on the fixing roller 2 makes with the surface of the fixing roller 2 obtained before the separation claw 51 abuts on the fixing roller 2, i.e., the tangential line of the surface of the fixing roller 2 obtained at the above-mentioned position before the separation claw 51 abuts on the fixing roller 2, is an acute angle, which is less than 90°.

FIG. 7(*a*) shows a case where the amount of intrusion δ is equal to the radius of curvature R of the fore end of the separation claw 51. As shown in FIG. 7(*a*), in this case, the intersecting angle θ of the fore end of the separation claw 51 with respect to the surface of the fixing roller 2 is 90°. FIG. 7(*b*) shows a further case where the amount of intrusion δ is two times as much as the radius of curvature R of the fore end of the separation claw 51. In that case, the intersecting angle o of the fore end of the separation claw 51 with respect to the surface of the fixing roller 2 is more than 90° and is equal to the setting angle θ0 (130°) of the separation claw 51.

The mechanism of the arrangement of the first embodiment, which ensures adequate separability for a recording member having a sharp edged fore end surface, is considered to be as follows.

In a case where the amount of intrusion δ of the fore end of the separation claw 51 is equal to the radius of curvature R of the fore end, the intersecting angle θ of the separation claw 51 with respect to the surface of the fixing roller 2 is 90°. When the recording member 100 comes to the fore end of the separation claw 51, the recording member 100 moves from below along the surface of the fixing roller 2, as indicated by a two-dot chain line as viewed in FIG. 7(*a*). In this instance, if the intersecting angle θ is an acute angle as shown in FIG. 6(*b*), the sharp edged fore end of the recording member 100 comes in between the fore end of the separation claw 51 and the surface of the fixing roller 2. On the other hand, if the intersecting angle θ is 90° as shown in FIG. 7(*a*), the recording member 100 collides with the separation claw 51 to be separated from the fixing roller 2. Even if the recording member 100 has a sharp edged end surface, its fore end edge is not truly sharp and such a recording member also can be separated if the intersecting angle θ is an obtuse angle of not less than 90°. Considering such a mechanism, therefore, it is important that the intersecting angle θ must be an obtuse angle of not less than 90°. This angle presents a borderline of making a difference in separability.

Table 2 below shows the results of tests conducted with the abutting pressure F on the fixing roller 2 set at 40 gf while varying the radius of curvature R of the fore end of the separation claw. The results of tests include the separability, scars inflicted on the fixing roller and the service life of the fixing roller obtained from the use of ordinary paper sheets.

TABLE 2

| Radius of curvature R of fore end of separation claw (μm): | 70 | 50 | 30 | 15 |
|---|---|---|---|---|
| Amount of intrusion δ (μm): | 50 | 54 | 58 | 65 |
| Ratio of amount of intrusion δ to radius of curvature R of fore end: | 0.71 | 1.08 | 1.93 | 4.33 |
| Frequency of jamming with sharp edged recording member (%): | 70 | 0 | 0 | 0 |
| Scars of roller due to jamming by sharp edged recording member (%): | 100 | — | — | — |
| Service life of roller with ordinary paper (10,000 sheets): | 30 | 22 | 10 | 2 |

As shown in Table 2 above, the amount of intrusion δ of the fore end of the separation claw 51 into the fixing roller 2 was not much varied by the variations of the radius of curvature R of the fore end of the separation claw 51. This is believed to be attributable to the fact that the surface of the fixing roller 2 is formed by coating the silicone rubber layer 22 which is employed as an elastic layer with the PTFE layer 23 which is less deformable than the silicone rubber layer 22.

According to the results of tests shown in Table 2, no paper jamming took place, i.e., the frequency of occurrence of jamming was 0%, despite of the use of the recording member having a sharp edged end surface with the ratio δ/R of the amount of intrusion δ to the radius of curvature R arranged to be not less than 1.0. With the ratio δ/R arranged to be less than 1.0, however, jamming with the recording member took place to inflict scars on the roller by heaving and pushing upward the separation claw 51. The service life of the fixing roller 2 with ordinary paper sheets was longer when the amount of intrusion δ was less.

Therefore, it is possible to secure adequate separability for a sharp end edged recording member to prevent the sudden termination of service life of the fixing roller, while adequately maintaining the service life of the fixing roller for a rectangular end edged recording member such as ordinary paper sheets, with the fixing device arranged to have the ratio δ/R of the amount of intrusion δ to the radius of curvature R set not less than 1.0 and not more than 2.0, i.e., with the amount of intrusion δ arranged to be not less than the radius of the circle of curvature of the fore end of the separation claw 51 and not more than the diameter of the circle of curvature of the fore end of the separation claw 51, even if the radius of curvature R of the fore end of the separation claw 51 is changed.

In the case of Table 2, the optimum radius of curvature of the fore end of the separation claw 51 was 50 μm or thereabout because the abutting pressure F of the separation claw 51 is fixed. With the abutting pressure F varied, however, the radius of curvature R can be changed within a range from 5 to 100 μm or thereabout. Assuming that the fixing device is an actually manufactured product, the fore end of the separation claw is so sharp at a radius of curvature of 5 μm or less to make discussion about the radius of curvature of the fore end meaningless. The radius of curvature set at 100 μm or more, on the other hand, necessitates the abutting pressure F to be vary much increased to obtain the amount of intrusion which is not less than the radius of curvature R, as will be understood from FIG. 4. Such a great increase of the abutting pressure F then increases a load on the fixing roller 2 to hinder the effort to increase the service life of the roller.

Therefore, according to the invention, the radius of curvature R of the fore end of the separation claw 51 is set within a range from 5 to 100 μm. Setting the radius of curvature R within such a range effectively gives an advantageous effect.

Table 3 below shows the results of tests conducted while varying the film thickness of the silicone rubber layer 22 of the fixing roller 2. The results of tests shown in Table 3 include the separability, scars of the fixing roller and the service life of the fixing roller 2 obtainable with an ordinary paper sheets used. For the tests, the abutting pressure F of the fore end of the separation claw was fixed at 40 gf and the radius of curvature R was fixed at 50 μm.

TABLE 3

| Film thickness of silicone rubber layer (μm): | 150 | 300 | 600 |
|---|---|---|---|
| Amount of intrusion δ (μm): | 30 | 54 | 105 |
| Ratio of amount of intrusion δ to radius of curvature R of fore end: | 0.60 | 1.08 | 2.1 |
| Frequency of jamming with sharp edged recording member (%): | 95 | 0 | 0 |
| Scars of roller due to jamming by sharp edged recording member (%): | 100 | — | — |
| Service life of roller with ordinary paper sheets (10,000 sheets): | 35 | 22 | 10 |

As shown in Table 3 above, when the film thickness of the silicone rubber layer 22 of the fixing roller 2 was decreased to 150 μm, the amount of intrusion δ of the fore end of the separation claw 51 decreased. Then, the ratio δ/R of the amount of intrusion δ to the radius of curvature R became smaller to bring about a state in which jamming with the sharp end edged recording member was apt to take place. An increase in film thickness of the silicone rubber layer 22 to 600 μm permitted an increase of the amount of intrusion δ but shortened the service life of the fixing roller 2 for the ordinary paper sheets. This is believed to result from a large recess incurred in the PTFE layer 23 by the large thickness of the silicone rubber layer 22 which is an elastic layer, as shown in FIG. 7(*b*).

However, in a case where the film thickness of the silicone rubber layer 22 was 150 μm, jamming occurred to instantly inflict scars on the fixing roller 2 when a recording member having a sharp edged end surface was passed. Therefore, in order to optimize the separability and the service life of the fixing roller 2, the ratio δ/R of the amount of intrusion δ to the radius of curvature R must be set within a range from 1.0 to 2.0 and preferably at a value a little more than 1.0, also in a case where the amount of intrusion δ is to be varied by adjusting the film thickness of the silicone rubber layer 22.

Table 4 below shows the results of tests conducted while varying the film thickness of the PTFE layer 23 of the fixing roller 2. The results shown in Table 4 include the separability, scars of the fixing roller and the service life obtained with ordinary paper sheets. In the tests, the abutting pressure F of the fore end of the separation claw 51 was fixed at 40 gf and the radius of curvature R was fixed at 50 μm.

TABLE 4

| Film thickness of PTFE layer (μm): | 30 | 20 | 10 | 0 |
|---|---|---|---|---|
| Amount of intrusion δ (μm): | 23 | 54 | 93 | 155 |
| Ratio of amount of intrusion δ to radius of curvature R of fore end: | 0.46 | 1.08 | 1.86 | 3.1 |
| Frequency of jamming with sharp edged recording member (%): | 100 | 0 | 0 | 0 |
| Scars of roller due to jamming by sharp edged recording member (%): | 100 | — | — | — |
| Service life of roller with ordinary paper (10,000 sheets): | 40 | 22 | 8 | 0.5 |

As shown in Table 4 above, when the film thickness of the PTFE layer 23 of the fixing roller 2 was set at 30 μm, the amount of intrusion δ of the fore end of the separation claw 51 into the fixing roller 2 decreased and the ratio of the amount of intrusion δ to the radius of curvature R of the fore end became smaller to bring about a state in which jamming with the recording member having a sharp edged fore end surface was apt to take place. When the film thickness of the PTFE layer 23 was set at 10 μm, the service life obtainable with the use of ordinary paper sheets became shorter, although the amount of intrusion δ became adequate. This is also believed to result from the large recess of the PTFE layer 23, as shown in FIG. 7(*b*).

With the amount of intrusion δ set unvarying, the thicker thickness of the PTFE layer 23 is of course more advantageous in respect of the termination of service life due to abrasion. Therefore, the thicker thickness of the PTFE layer 23 makes the service life of the roller much longer where ordinary paper sheets are used.

However, jamming occurred to instantly inflict scars on the fixing roller 2 when a recording member having a sharp edged end surface was passed. Therefore, in order to optimize the separability and the service life of the fixing roller, the ratio δ/R of the amount of intrusion δ to the radius of curvature R must be set within a range from 1.0 to 2.0 and preferably at a value a little more than 1.0, also in a case where the amount of intrusion δ is to be varied by adjusting the film thickness of the PTFE layer 23.

Table 5 below shows the results of tests conducted while varying the rubber hardness of the silicone rubber layer 22 of the fixing roller 2. The test results shown in Table 5 include the separability, scars of the fixing roller, the service life of the fixing roller obtainable with ordinary paper sheets, etc. For the tests, the abutting pressure F of the fore end of the separation claw 51 was fixed at 40 gf and the radius of curvature R was set at 50 μm. The rubber hardness was measured in accordance with JIS-A.

TABLE 5

| Hardness of silicone rubber layer (°) (JIS-A): | 80 | 70 | 50 |
|---|---|---|---|
| Amount of intrusion δ (μm): | 44 | 54 | 121 |
| Ratio of amount of intrusion δ to radius of curvature R of fore end: | 0.88 | 1.08 | 2.42 |
| Frequency of jamming with sharp edged recording member (%): | 55 | 0 | 0 |
| Scars of roller due to jamming by sharp edged recording member (%): | 100 | — | — |
| Service life of roller with ordinary paper sheets (10,000 sheets): | 29 | 22 | 8 |

As shown in Table 5 above, when the rubber hardness of the silicone rubber layer 22 of the fixing roller 2 was at 80°, the amount of intrusion δ of the fore end of the separation claw 51 into the fixing roller 2 decreased and the ratio of the amount of intrusion δ to the radius of curvature R became smaller to bring about a state in which jamming with the recording member having a sharp edged end surface was apt to take place. This is also believed to result from the large recess of the PTFE layer 23, as shown in FIG. 7(*b*).

However, jamming occurred to instantly inflict scars on the fixing roller 2, also at the rubber hardness of 80° of the silicone rubber layer 22 of the fixing roller 2, when a recording member having a sharp edged end surface was passed. Therefore, in order to optimize the separability and the service life of the fixing roller 2, the ratio δ/R of the amount of intrusion δ to the radius of curvature R must be set within a range from 1.0 to 2.0 and preferably at a value a little more than 1.0, also in a case where the amount of intrusion δ is to be varied by adjusting the rubber hardness of the silicon rubber layer 22.

Second Embodiment

The fore end of the separation claw 51 in the first embodiment is formed in a curved surface which has a single radius of curvature R connecting two ridge lines, as shown in FIG. 2. The first embodiment is arranged to make enhancement of the separability and an increase of the service life of the fixing roller compatible with each other by correlating the fore end shape of the separation claw with the amount of intrusion δ on the basis the radius of curvature R of the curved surface.

Figure 8:
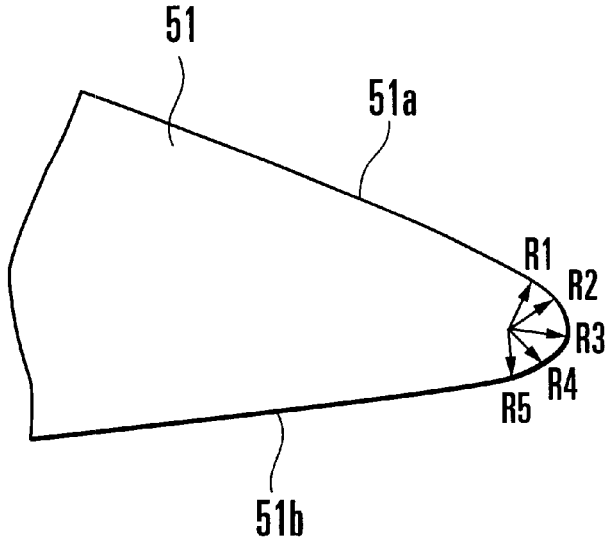
FIG. 8 is a sectional view showing the fore end of a separation claw used in a second embodiment of the invention, the fore end being formed in a curved shape to have a radius of curvature varying in a plural manner.

In the case of the second embodiment, on the other hand, the fore end curved surface of the separation claw 51 is formed to gradually increase the curvature from the two edge lines 51*a* and 51*b* as expressed by a relation of "R1>R2>R3, R5>R4>R3", as shown in FIG. 8. In a case where the fore end shape of the separation claw 51 cannot be expressed by a single radius of curvature, as in the case of the second embodiment, it is hardly possible to decide the amount of intrusion δ of the fore end of the separation claw 51 by using one radius of curvature.

Therefore, the second embodiment is contrived on the basis of the following. As is apparent from FIG. 6(*a*) to FIG. 7(*b*) which show the mechanism of separability in relation to the amount of intrusion δ, it is important that the intersecting angle θ which the separation claw 51 makes with the surface of the fixing roller 2 is not less than 90° and less than the setting angle θ0 of the separation claw 51 with respect to the fixing roller 2 (the angle which the bottom surface of the fore end part of the separation claw 51 makes with the tangential line of the surface of the fixing roller 2).

Table 6 below shows the results of tests conducted in the second embodiment in which the curved fore end surface of the separation claw 51 was arranged to have a plurality of radii of curvature. The tests were conducted for the separability and scars inflicted on the fixing roller 2 with a recording medium having a sharp edged fore end surface passed, the service life of the fixing roller 2 with ordinary paper sheets passed, etc. In conducting the tests, the setting angle θ0 of the separation claw 51 was set at 130°, as in the case of the first embodiment. The intersecting angle θ of the separation claw 51 was obtained by measuring the amount of intrusion δ of the fore end of the separation claw 51 into the fixing roller 2 and by conducting a computing operation on the basis of the result of measurement, the shape of the fixing roller 2 and the geometric allocation thereof.

TABLE 6

| Abutting pressure F (gf): | 20 | 30 | 40 | 80 | 150 | 200 |
|---|---|---|---|---|---|---|
| Amount of intrusion δ (μm): | 35 | 39 | 48 | 72 | 100 | 125 |
| Intersecting angle θ (°) | 73 | 84 | 92 | 110 | 130 | 130 |
| Frequency of jamming with sharp edged recording member (%): | 100 | 35 | 0 | 0 | 0 | 0 |
| Scars of roller due to jamming by sharp edged recording member (%): | 100 | 100 | — | — | — | — |
| Service life of roller with ordinary paper (10,000 sheets): | 35 | 28 | 22 | 13 | 7 | 4 |

Figure 9:
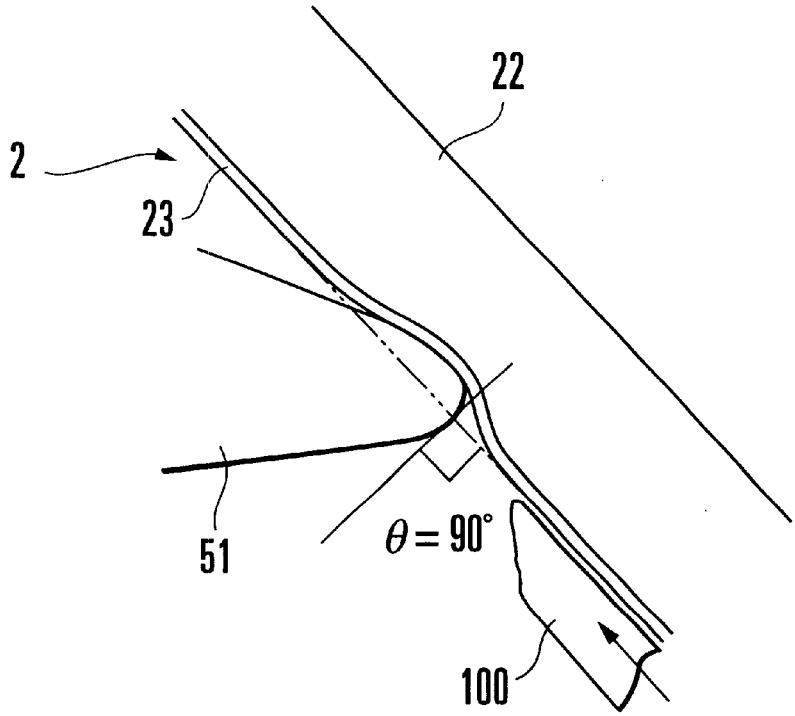
FIG. 9 is a sectional view showing a case where an intersecting angle θ which the fore end of the separation claw shown in FIG. 8 intruding into the surface of a fixing roller makes with the surface of the fixing roller is 90°.

As apparent from Table 6 above, the recording member having a sharp edged end surface caused jamming when the intersecting angle θ of the fore end of the separation claw with respect to the surface of the fixing roller 2 was less than 90°, and did not cause jamming when the intersecting angle θ was not less than 90°. This is because the intersecting angle θ of 90° of the fore end of the separation claw 51 is a borderline between intrusion and nonintrusion of the recording member 100 in between the fixing roller 2 and the fore end of the separation claw 51, as shown in FIG. 9. When the intersecting angle θ was less than 90°, scars were inflicted 100% on the fixing roller 2 by jamming and the service life of the fixing roller 2 was shortened by the use of the sharp edged recording member 100.

As for the use of ordinary paper sheets, the service life of the fixing roller 2 decreased accordingly as the intersecting angle θ of the fore end of the separation claw 51 increased. The service life of the fixing roller 2 became particularly short when the intersecting angle θ was equal to or above the setting angle θ0 of 130° of the separation claw 51 with respect to the fixing roller 2.

Under the condition shown in FIG. 7(*b*), when the amount of intrusion δ of the fore end of the separation claw 51 is sufficiently large, the intersecting angle θ is no longer the angle which the fore end curved surface of the separation claw 51 makes with the original surface of the fixing roller 2 as indicated by a two-dot chain line in FIG. 7(*b*). Under this condition, the intersecting angle θ becomes equal to the setting angle θ0 which the bottom surface of the separation claw makes with the original surface of the fixing roller 2, and never becomes more obtuse than that angle. Then, as is apparent from FIG. 7(*b*), the PTFE layer 23 of the fixing roller 2 is greatly recessed into a shape of dynamically imposing a large load. As a result, the service life of the fixing roller 2 with the ordinary paper sheets becomes shorter under this condition.

In other words, within such a region where the intersecting angle θ becomes equal to the setting angle θ0 and never becomes more obtuse as shown in FIG. 7(*b*), the separability of the fore end surface of the separation claw 51 for the sharp edged recording member 100 remains the same while the service life of the fixing roller 2 decreases accordingly as the amount of intrusion δ of the fore end of the separation claw 51 increases. Therefore, in a case where the separation claw 51 is formed to have the curvature of its fore end curved surface vary to have a plurality of radii of curvature, it is important, for obtaining a longer service life of the fixing roller 2, to make the intersecting angle θ of the fore end of the separation claw 51 at an angle less than the setting angle θ0.

Further, as shown in Table 6, the service life of the fixing roller 2 for ordinary paper sheets becomes shorter accordingly as the intersecting angle θ increases. Therefore, adequate separability for the recording member 100 and the longer service life of the fixing roller 2 can be made compatible with each other by setting the intersecting angle θ of the fixing roller 2 at an angle which is slightly larger than 90°.

Third Embodiment

Figure 10:
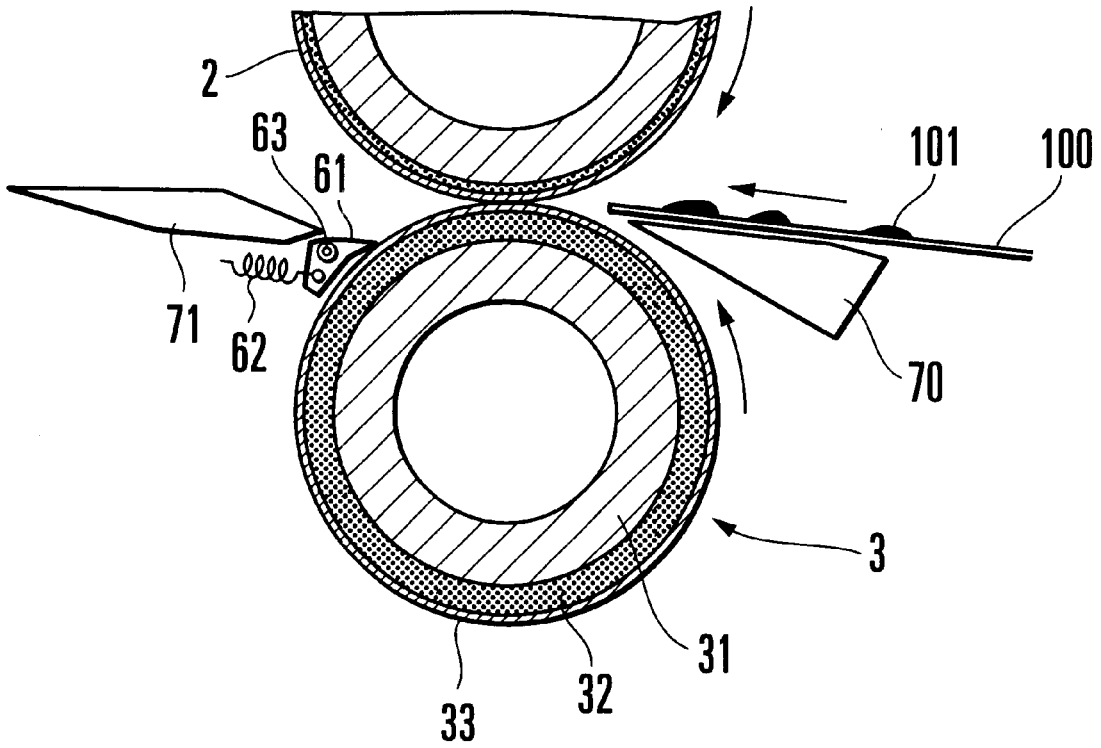
FIG. 10 is a sectional view showing a pressing roller which is provided with a separation claw in a third embodiment of the invention.

In the case of a third embodiment of the invention, the invention is applied to the pressing roller 3, instead of the fixing roller 2, as shown in FIG. 10.

The pressing roller 3 in the third embodiment is arranged basically in the same manner as the pressing roller 3 in the first embodiment. The pressing roller 3 is formed by coating a core metal 31 which is made of an alloy mainly made of iron. The core metal 31 is coated with a silicone rubber layer 32 of hardness 30° (JIS-A) serving as an elastic layer to a thickness of 5 mm. The silicone rubber layer 32 is further coated with a PFA tube of thickness of 100 μm, i.e., a PFA layer 33 of thickness of 100 μm. The pressing roller 3 is provided with a separation claw 61 on the exit side of a fixing nip part. The separation claw 61 is mounted on the body of the fixing device to be swingable on a shaft 63. A tension spring 62 is arranged to pull the separation claw 61 to swing on the shaft 63 in such a way as to cause the separation claw 62 to abut on the surface of the pressing roller 3 with a predetermined abutting pressure. In FIG. 10, the same elements as those of the first embodiment are indicated by the same reference numerals as the reference numerals shown in FIG. 1.

Table 7 below shows the results of tests conducted in the third embodiment while varying the radius of curvature R of the fore end of the separation claw 61. The test results shown in Table 7 include the amount of intrusion δ of the fore end of the separation claw 61 obtained when the fore end of the separation claw 61 abutted on the pressing roller 3, the frequency of jamming having occurred at the time of double-sided fixing, the service life of the pressing roller 3 with ordinary paper sheets used, etc.

Generally, the jamming with a recording member tends to take place by clinging of the recording member to the fixing roller 2 which is bearing a toner image thereon. Therefore, to examine how the jamming with the recording member takes place on the side of the pressing roller 3, double-sided image forming tests were conducted by putting a solid black image on the first surface of the recording member and putting no image (a solid white image) on the second surface of the recording member. Then, the recording member was arranged such that, at the time of a fixing action on the second surface of the recording member, the solid white surface which was not apt to cling came on the side of the fixing roller 2 while the solid black surface which was apt to cling came on the side of the pressing roller 3. The frequency of jamming shown in Table 7 was obtained under this condition.

TABLE 7

| Radius of curvature R of fore end of separation claw (μm): | 35 | 25 | 15 |
|---|---|---|---|
| Amount of intrusion δ (μm): | 29 | 30 | 32 |
| Ratio of amount of intrusion δ to radius of curvature R of fore end: | 0.83 | 1.2 | 2.13 |
| Frequency of jamming at the time of double-sided fixing (%): | 40 | 0 | 0 |
| Service life of roller with ordinary paper (10,000 sheets): | 60 | 55 | 35 |

As shown in Table 7 above, the frequency of occurrence of jamming decreased when the ratio δ/R of the amount of intrusion δ of the fore end of the separation claw 61 into the surface of the pressing roller 3 to the radius of curvature R of the fore end of the separation claw 61 was not less than 1.0. In the third embodiment, the PFA layer 33 of the pressing roller 3 is 100 μm in thickness and thus has a sufficient film thickness strength as compared with the fixing roller 2. Therefore, minor changes in the radius of curvature R of the fore end of the separation claw 61 did not cause the amount of intrusion δ of the fore end to vary to a great extent.

When the ratio of the amount of intrusion δ to the radius of curvature R is at a value less than 1.0, the jamming took place. However, since the PFA layer 33 was thick measuring 100 μm, no fetal scar was inflicted on the surface of the pressing roller 3. Scars inflicted by jamming were not so serious as to necessitate the pressing roller to be immediately replaced with new one.

The service life of the pressing roller obtained with ordinary paper sheets used was examined by passing the ordinary paper sheets under an ordinary image forming condition. However, variations in the ratio δ/R did not make much difference in the service life. Therefore, in the case of the pressing roller also, in order to ensure a maximum service life length without causing any jamming, the ratio of the amount of intrusion δ of the fore end of the separation claw 61 into the surface of the pressing roller 3 to the radius of curvature R of the fore end must be set to be at least 1.0 and not exceeding 2.0 or preferably at a value slightly above 1.0.

In each of the embodiments disclosed, the separation claw is arranged only either at the fixing or pressing roller. However, the invention likewise applies also to a case where separation claws are arranged both at the fixing roller and at the pressing roller.

According to the invention, as described above, the fixing roller having an elastic layer is provided with a separation claw which is arranged to have its fore end come into contact with and to intrude into the surface of the roller. The fore end of the separation claw has a minute curved surface. The amount of intrusion δ of the fore end of the separation claw is arranged to be not less than the radius R of a circle of curvature (radius of curvature) of the curved surface of the fore end and not more than the diameter of the circle of curvature. This arrangement enables the roller to have a long service life. The recording member separating effect can be enhanced by setting the amount of intrusion δ at a value slightly above the radius of curvature R. Further, the intersecting angle θ which the tangential line of the fore end of the separation claw intruding into the surface of the roller at a position where the fore end of the separation claw intersects the surface of the roller before the separation claw abuts on the roller makes with the surface of the roller obtained before the separation claw abuts on the roller is set to be not less than 90° and less than the setting angle θ0 of the separation claw with respect to the surface of the roller. The intersecting angle θ is preferably set to be slightly above 90°. Therefore, the arrangement of the invention applies also to a case where the fore end curvature of the separation claw varies to have a plurality of radii of curvature. Further, the amount of intrusion of the fore end of the separation claw can be easily optimized by adjusting the abutting pressure of the fore end of the separation claw on the surface of the roller or by adjusting the thickness or hardness of the roller-coating layers including an elastic layer of the roller.

Therefore, in accordance with the invention, a fixing device can be arranged to have good separability for such a recording member that is vulnerable to heat, has a sharp end edge angle or is extremely thin, while ensuring a long service life of the roller.

While the invention has been described with respect to the preferred embodiments thereof, the invention is not limited to the embodiments disclosed. To the contrary, the invention is intended to cover various modifications and equivalent arrangements included within the spirit and scope of the appended claims.

What is claimed is:

1. A fixing device, comprising:

a roller arranged to come into contact with a recording member bearing an unfixed image thereon so as to fix the unfixed image to the recording member; and a separation member arranged to come into contact with said roller so as to separate the recording member from said roller, wherein a fore end of said separation member on a side for coming into contact with said roller is formed in a curved surface and intrudes into said roller, wherein a radius of curvature of a portion of said separation member, which is in contact with said roller is larger than 5 μm and smaller than 100 μm, and wherein an amount of intrusion of said separation member into a surface of said roller is not less than a radius of a circle of curvature of the curved surface of the fore end of said separation member and not more than a diameter of said circle of curvature.

2. A fixing device according to claim 1, wherein the amount of intrusion of said separation member is an amount near and above the radius of said circle of curvature.

3. A fixing device according to claim 1, wherein said roller has an elastic layer.

4. A fixing device according to claim 3, wherein said roller has a releasing layer on said elastic layer.

5. A fixing device according to claim 1, further comprising urging means for urging the fore end of said separation member toward said roller.

6. A fixing device according to claim 1, wherein said roller is arranged to come into contact with a surface of the recording member on a side having the unfixed image.

7. A fixing device according to claim 1, wherein said roller is arranged to come into contact with a surface of the recording member on a side opposite to a side having the unfixed image.

8. A fixing device according to claim 1, wherein, the following condition is satisfied:

$$90° \leqq \theta < \theta 0$$

where θ is an angle which a tangential line of the fore end of said separation member at a position where a surface on a side, which the recording member at the fore end of said separation member is guided in a condition where said separation member presses said roller intersects a surface of said roller before said separation member is in contact with said roller makes with a tangential line of the surface of said roller before said separation member is in contact with said position, and θ0 is an angle which a surface of said separation member for guiding the recording member makes with a tangential line of the surface of said roller at a position where a line of the surface of said separation member in a direction of guiding the recording member intersects the surface of said roller before said separation member comes into contact with said roller.

* * * * *

UNITED STATES PATENT AND TRADEMARK OFFICE

CERTIFICATE OF CORRECTION

PATENT NO. : 6,456,817 B1
DATED : September 24, 2002
INVENTOR(S) : Yuji Kamiya

It is certified that error appears in the above-identified patent and that said Letters Patent is hereby corrected as shown below:

Column 6,
Line 61, “increases” should read -- increase --.

Column 7,
Line 58, “intrusion 6” should read -- intrusion δ --.

Column 8,
Line 36, “angle o” should read -- angle θ --.

Column 10,
Line 16, “sheets” should read -- sheet --.

Column 15,
Line 15, “with” should read -- with a --.

Signed and Sealed this

Fourth Day of March, 2003

JAMES E. ROGAN
*Director of the United States Patent and Trademark Office*